US008740647B1

(12) United States Patent
Cyr

(10) Patent No.: US 8,740,647 B1
(45) Date of Patent: Jun. 3, 2014

(54) REDUCED CROSSTALK IN A MULTI-CHANNEL CONDUCTIVE BODY CONNECTOR

(75) Inventor: Gregory J. Cyr, Winfield, IL (US)

(73) Assignee: ARRIS Enterprises, Inc., Suwanee, GA (US)

( * ) Notice: Subject to any disclaimer, the term of this patent is extended or adjusted under 35 U.S.C. 154(b) by 50 days.

(21) Appl. No.: 13/019,892

(22) Filed: Feb. 2, 2011

Related U.S. Application Data

(60) Provisional application No. 61/300,738, filed on Feb. 2, 2010.

(51) Int. Cl.
*H01R 13/648* (2006.01)
*H01R 12/16* (2006.01)
*H01R 13/6588* (2011.01)

(52) U.S. Cl.
CPC ..... *H01R 23/688* (2013.01); *H01R 13/6588* (2013.01); *Y10S 439/941* (2013.01)
USPC ..... 439/607.12; 439/941

(58) Field of Classification Search
USPC ..... 439/607.01, 607.03, 607.05, 607.08, 439/941, 607.11, 607.12
See application file for complete search history.

(56) References Cited

U.S. PATENT DOCUMENTS

| | | | | | |
|---|---|---|---|---|---|
| 4,401,355 | A * | 8/1983 | Young | 439/607.11 |
| 4,451,107 | A * | 5/1984 | Dola et al. | 439/607.1 |
| 4,781,604 | A * | 11/1988 | Sadigh-Behzadi et al. | 439/101 |
| 4,824,383 | A * | 4/1989 | Lemke | 439/108 |
| 4,897,046 | A * | 1/1990 | Tengler et al. | 439/579 |
| 5,151,036 | A * | 9/1992 | Fusselman et al. | 439/108 |
| 5,175,928 | A * | 1/1993 | Grabbe | 29/884 |
| 5,178,549 | A * | 1/1993 | Neumann et al. | 439/74 |
| 5,228,871 | A * | 7/1993 | Goodman | 439/607.56 |
| 5,577,936 | A * | 11/1996 | Hahn | 439/607.28 |
| 6,283,792 | B1 * | 9/2001 | Tolmie et al. | 439/607.08 |
| 6,561,850 | B2 * | 5/2003 | Letourneau et al. | 439/607.08 |
| 6,648,689 | B1 * | 11/2003 | Billman et al. | 439/607.07 |
| 8,083,553 | B2 * | 12/2011 | Manter et al. | 439/701 |
| 8,115,107 | B2 * | 2/2012 | Behziz | 174/261 |
| 8,167,651 | B2 * | 5/2012 | Glover et al. | 439/607.08 |
| 2007/0059961 | A1 * | 3/2007 | Cartier et al. | 439/191 |
| 2011/0151716 | A1 * | 6/2011 | Kondo | 439/607.01 |

* cited by examiner

*Primary Examiner* — Neil Abrams
*Assistant Examiner* — Travis Chambers
(74) *Attorney, Agent, or Firm* — Troy A. Van Aacken

(57) ABSTRACT

Apparatus and methods can provide for reduced crosstalk in a conductive body connector. In some implementations, such apparatus and methods can include applying or embedding a selectively resistive material between channel elements to reduce return ground current sharing. The selectively resistive material can operate to increase the effective resistance between channels and thereby reduce crosstalk.

7 Claims, 6 Drawing Sheets

REDUCED CROSSTALK IN A MULTI-CHANNEL CONDUCTIVE BODY CONNECTOR

CROSS REFERENCE TO RELATED APPLICATION

This application claims the benefit of priority under 35 U.S.C. 119(e) to the filing date of Cyr, U.S. provisional patent application No. 61/300,738 entitled "Reduced Crosstalk in a Multi-Channel Conductive Body Connector," which was filed Feb. 2, 2010, and is incorporated herein by reference in its entirety.

TECHNICAL FIELD

This disclosure relates to crosstalk in multi-channel connectors.

BACKGROUND

Connectors are present in many electronic applications and can operate to join electrical circuits or signals together. Due to the electrical properties, alternating electrical current (AC) or other time-varying current distributes itself within a conductor so that current density near the surface of the conductor is greater than at its core. This electromagnetic phenomenon is often referred to as the skin effect. The skin effect allows a single conductive body to be used in connectors with multiple radio frequency (RF) channels because return ground currents will flow along an inside surface of an internal cavity into a respective ground pin. The conductive body connector attaches to the end of the cavity with interfaces such as an electronic circuit board, cable, or another connector. However, as the density for RF connectors increases, the problem of crosstalk becomes increasingly problematic.

Crosstalk is a phenomenon that produces an undesirable effect from one circuit or channel of an electrical transmission system to another circuit or channel. Crosstalk can be caused by capacitive, inductive or conductive coupling. In telecommunications and telephony, crosstalk can be signals induced on a connection that include components of speech or signal tones from another connection. In analog circuitry, crosstalk can distort nearby signals at the source or destination of the transmission. In wireless communications, crosstalk can be co-channel or adjacent-channel interference. In integrated circuit design, crosstalk can be an electrical signal affecting another nearby electrical signal in many environments such as, for example, a circuit board, an integrated circuit, a handheld computational device, a transmission cable, or a connector.

Return current induced crosstalk in a multi-channel conductive body connector is generated when the return ground current of one channel flows to the signal pin and/or ground pin of another channel. This return current induced crosstalk is exacerbated by a conductive path available at the bottom edge of the conductive body connector, which can be exacerbated further as connector density increases or as a result of imperfect ground pin contacts. Although methods exist to remedy this problem, such as reducing impedance (including but not limited to effective resistance) to the ground pin(s), creating independent conductive bodies, or placing an insulator on the conductive connector body, such methods can be ineffective and/or cost prohibitive.

BRIEF DESCRIPTION OF THE DRAWINGS

Like reference numbers and designations in the various drawings indicate like elements.

DETAILED DESCRIPTION

Figure 1:
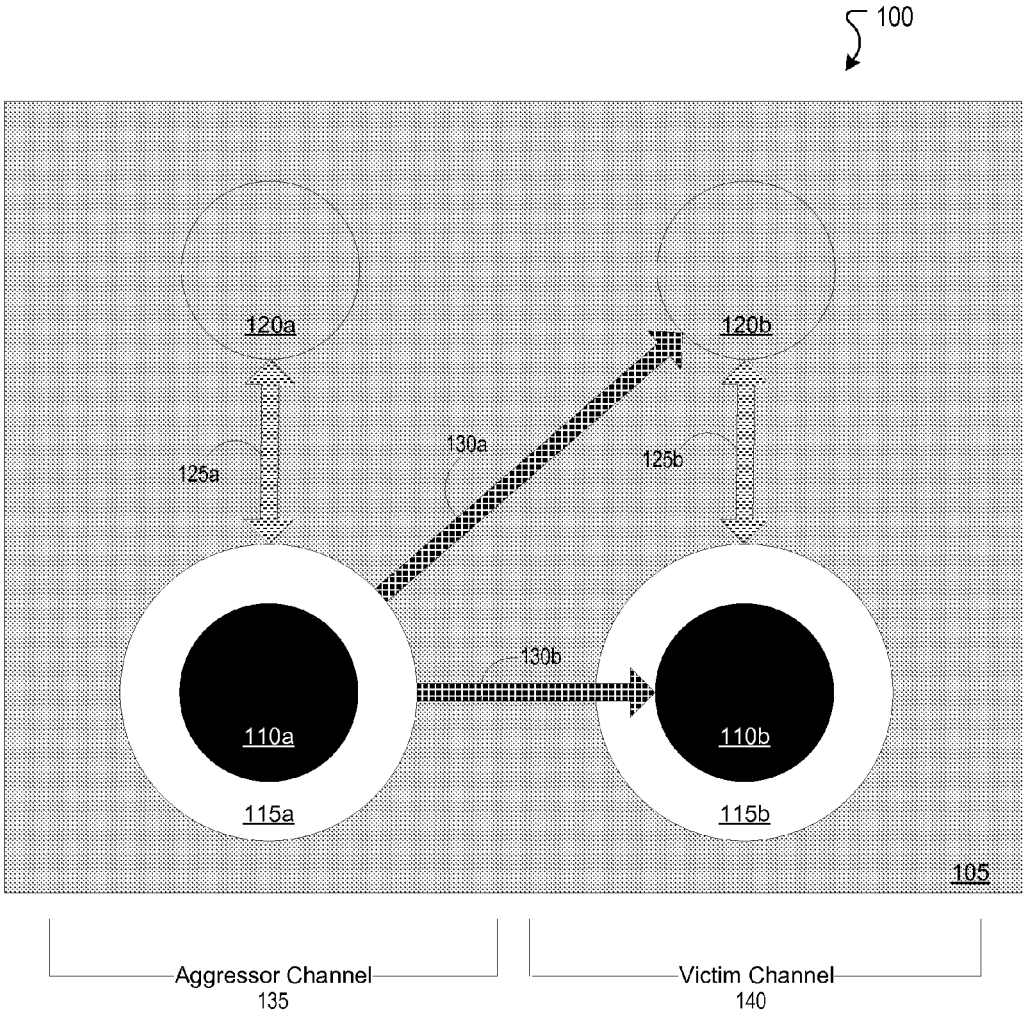
FIG. 1 (Prior Art)
FIG. 1 is a block diagram illustrating a bottom view of a prior art multi-channel conductive body connector showing return current induced crosstalk.

In some implementations of this disclosure, apparatus and methods can operate to reduce crosstalk in a multi-channel conductive body connector by reducing current flow between ground and/or signal pins. The connector can include elements such as a conductive body, signal pins, signal pin insulators, ground pin(s), and selectively resistive material used to reduce crosstalk. In some implementations, the connector can be manufactured with multiple channels in a conductive body. A multi-channel connector includes two or more channels within a single conductive body and/or connector. In some implementations, the conductive body can be comprised of a single material. The conductive body can be made of a conductive metal such as, for example, zinc or brass alloys and plated with nickel or tin alloys and/or finished in palladium, silver and/or gold. In other implementations, the conductive body can be made of a selectively resistive material and plated with a conductive material to enable signal transmission while retaining an un-plated portion of the selectively resistive conductive body to operate to reduce crosstalk in a multi-channel conductive body connector.

The multi-channel connector includes at least two signal pins embedded inside the conductive body and operable to transmit or receive signals. The signal pins can be made of a conductive metal such as, for example, copper alloy plated in tin, nickel, palladium, silver and/or gold. A signal pin can be surrounded by an embedded signal pin insulator operable to provide mechanical support to the center single pin conductor. The signal pin insulator material can be, for example, Teflon, nylon polyester, polystyrene, or another plastic material. Moreover, a signal pin can have one or more associated embedded ground pin formed from or connected to the conductive body and operable to transfer return ground current from a channel. In some implementations, the ground pin can be made of a separate material than the conductive body and attached to the conductive body during manufacturing. In other implementations, the ground pin can be formed from the conductive body. In still further implementations, the insulator can be an air gap separating the conductive body and signal pins.

Connector design often provides a path for return ground current to transfer back to the transmission source. In a system or apparatus using AC electrical current (in which the flow rate of electric charge alternates in direction) or other time-varying electrical current (in which the flow rate of electric charge changes over time), the skin effect dominates current flow and associated crosstalk. Thus, in this disclosure AC electrical current includes but is not limited to 60 Hz, 110/120V AC power source commonly used in North America and non-power source time-varying currents. In addition, other time-varying current sources that change the direction and/or magnitude of current flow may benefit from this disclosure. These benefits are especially useful for systems including but not limited to electric signal communication systems that induce crosstalk on nearby electric signal communication systems, media, or channels.

A selectively resistive material can be applied between selected signal pins and/or ground pin(s) and operate to reduce crosstalk by increasing the effective resistance between signal pins and/or ground pin(s). The effective resistance of the selectively resistive material can include effective resistances greater than the effective resistance of the conductive body and less than the effective resistance of the insulator material. The selectively resistive material may vary based on the effective resistance of the conductive body and/or ground pin(s). In some implementations, the selectively resistive material can be embedded into the conductive body. In other implementations, the selectively resistive material can be applied on the surface of the connector during the manufacturing process. In still further implementations, the selectively resistive material can be an epoxy, metal plate, or coating. In alternative implementations, the conductive body can be made of the selectively resistive material and coated and/or plated with a more conductive material in areas that can allow the area of un-plated resistive material to reduce crosstalk.

FIG. 1 is a block diagram illustrating a bottom view of a multi-channel conductive body connector showing return current induced crosstalk. The connector 100 can include a metallic conductive body 105 and can be operable to include two signal pins 110*a-b*, two signal pin insulators 115*a-b*, and two ground pins 120*a-b*. The conductive body 105 can be implemented with alloys of copper, nickel, zinc, tin, other metal, or another substantially conductive material.

In this example, two signal pins 110*a-b* are embedded in the conductive body 105. These signal pins 110*a-b* can operate to transmit and/or receive data in the form of electrical signals. The signal pins 110*a-b* can be comprised of aluminum, copper, titanium, iron, nickel alloy, other metal, or another substantially conductive material. Signal pin insulators 115*a-b* can be embedded in the conductive body 105 and surround signal pins 110*a-b*. Signal pin insulators 115*a-b* can operate to maintain signal quality and shield external noise or interference. Signal pin insulators 115*a-b* also can operate to separate the signal pin from the ground and/or other signals and also can provide mechanical support. Signal pin insulators 115*a-b* can be made of insulative materials including, for example, nylon, foam, polyester, or fiberglass. It should be understood that the signal pin insulators 115*a-b* are not required for the connector.

Two ground pins 120*a-b* can be embedded in the conductive body 105 of the connector 100 and can operate to transfer return ground currents 125*a-b*. The ground pin(s) 120*a-b* can be formed from the conductive body 105 or can be made of a separate material such as aluminum, copper, titanium, iron, or nickel alloy, and subsequently connected to the conductive body 105. In some implementations, one ground pin can operate to transfer return ground currents 125*a-b*.

The signal pins 110*a-b* can operate to transmit and/or receive signals to/from one end of the connector to the device, connector, or apparatus to the other end. In addition, the ground pin(s) 120*a-b* can operate to transfer return ground current 125*a-b* from the signal transmission. A return ground current 125*a* from one channel is intended to flow to its respective ground pin 120*a* along the surface of the conductive body 105 based upon the skin effect. Correspondingly, the adjacent channel return ground current 125*b* is intended to flow to its respective ground pin 120*b*.

Return current induced crosstalk 130*a-b* occurs when return ground current from one channel (e.g., aggressor channel 135) flows to an adjacent channel's signal pin 110*b* and/or ground pin 120*b* (e.g., victim channel 140). The resulting crosstalk 130*a-b* can affect signal quality and transmission. In some implementations, return ground current can be shared among multiple signal pins and a single ground pin or multiple ground pins. In alternative implementations, the conductive body 105 can be made of the selectively resistive material and coated and/or plated with a more conductive material in areas that can allow the area of un-plated resistive material to reduce crosstalk.

Figure 2:
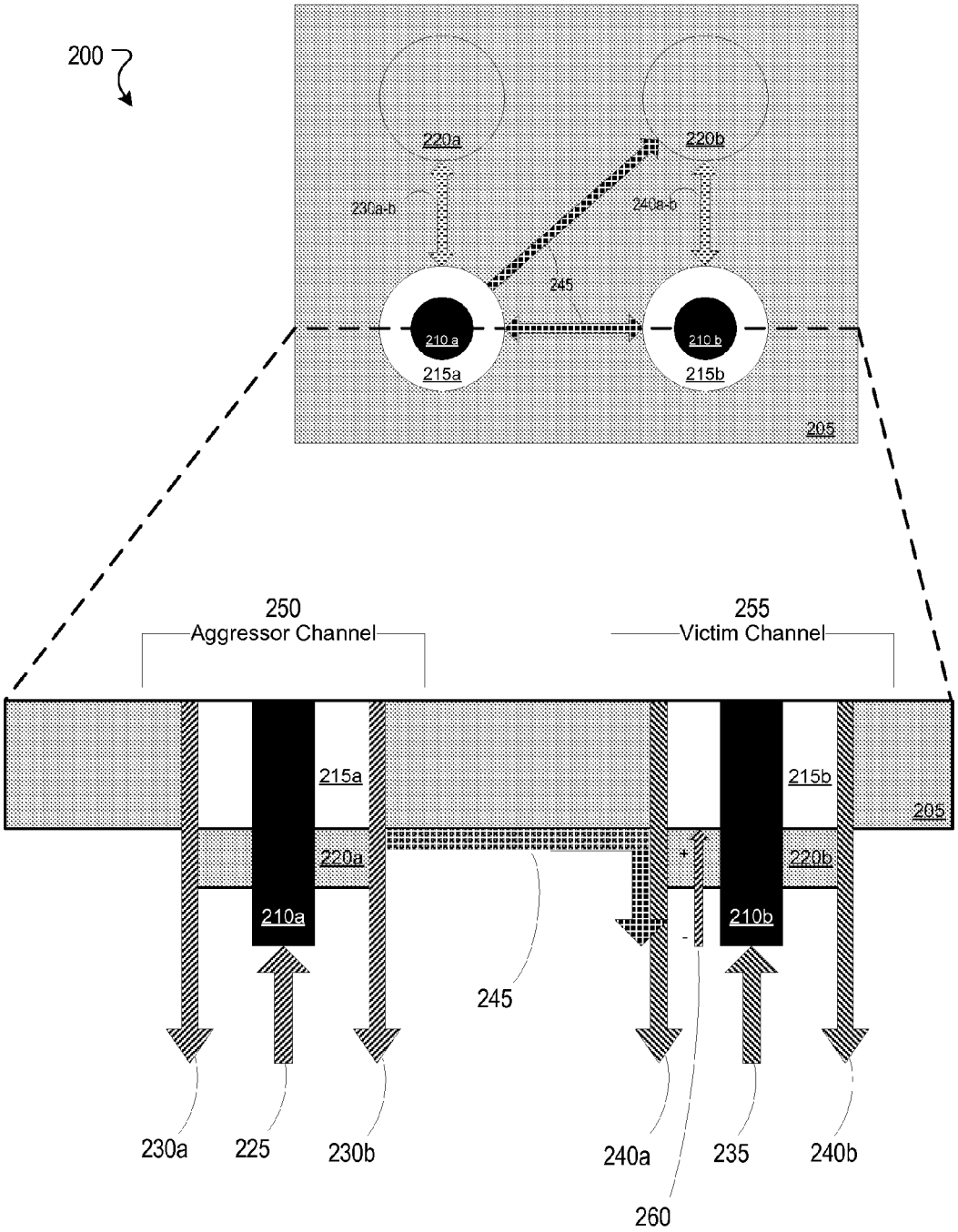
FIG. 2 (Prior Art)
FIG. 2 is a block diagram illustrating a bottom view and a cross-section view of a prior art multi-channel conductive body connector showing return current induced crosstalk.

FIG. 2 is a block diagram illustrating a cross-section of an example multi-channel conductive body connector showing return current induced crosstalk. The connector 200 can include a conductive body 205 (e.g., conductive body 105 of FIG. 1), signal pins 210*a-b* (e.g., signal pins 110*a-b* of FIG. 1), signal pin insulators 215*a-b* (e.g., signal pin insulators 115*a-b* of FIG. 1), and ground pins 220*a-b* (e.g., ground pins 120*a-b* of FIG. 1). It should be understood that there can be a singular ground pin. The signal pins 210*a-b* carry signals 225/235 to a connected apparatus. The return ground current 230*a-b* for a signal 225 is intended to flow to the nearest ground pin 220*a*. Correspondingly, a return ground current 240*a-b* for an adjacent signal 235 is intended to flow to its respective ground pin 220*b*.

Return current induced crosstalk 245 (e.g., crosstalk 130*a-b* of FIG. 1) occurs when one channel's return ground current 230*a-b* flows to an adjacent signal pin 210*b* and/or ground pin 220*b*. The originator of the offending return ground current can be identified as an aggressor channel 250. The receiver of offending return ground current can be identified as a victim channel 255. The crosstalk current 245 caused by the aggressor channel 250 can affect signal quality and transmission by adding a voltage 260 to the victim channel 255. In alternative implementations, the conductive body 205 can be made of the selectively resistive material and coated and/or plated with a more conductive material in areas that can allow the area of un-plated resistive material to reduce crosstalk. It should be understood that the signal pin insulators 215*a-b* are not required for the connector.

Figure 3:
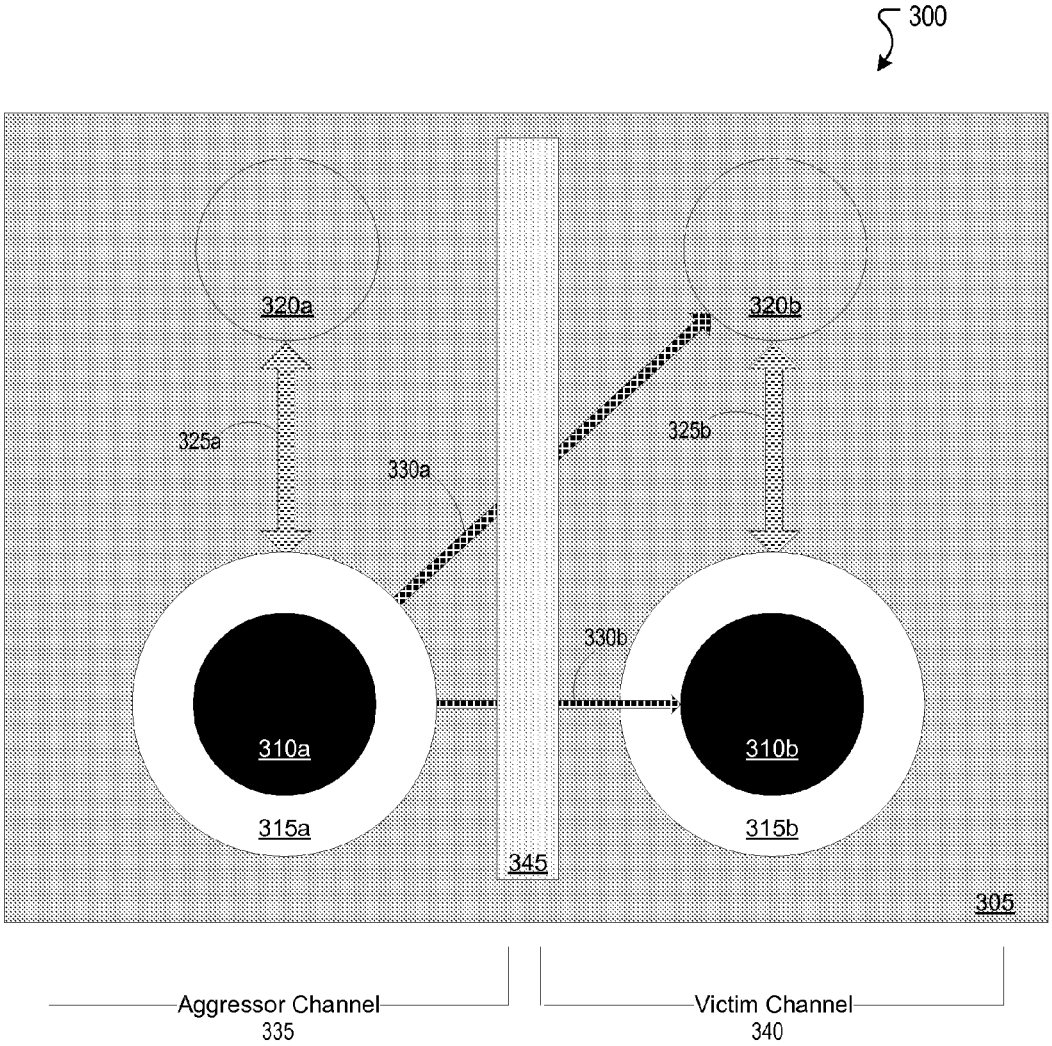
FIG. 3 is a block diagram illustrating an example bottom view of a multi-channel conductive body connector operating to reduce crosstalk.

FIG. 3 is a block diagram illustrating a bottom view of an example multi-channel conductive body connector operating to reduce crosstalk. In some implementations, the connector can be coupled to a circuit board or device. In other implementations, the connector can be coupled to another connector or a cable. The connector 300 can include a conductive body 305 made of a metal or other conductive material and operable to contain at least two signal pins 310*a-b*, at least two signal pin insulators 315*a-b*, and at least one ground pin 320*a-b*. In some implementations, the conductive body 305 can be made of a single body comprising one or more conductive materials. For example, the conductive body 305 can be made of one or more of aluminum, copper, titanium, iron, nickel alloy, other metal, or another substantially conductive material.

In some implementations, two signal pins 310*a-b* can be embedded into the conductive body 305. In other implementations, more than two signal pins are embedded in a conductive body 305. The signal pins 310*a-b* can operate to transmit and/or receive data in the form of electrical signals. In some implementations, the signal pins 310*a-b* can be made of one or more of aluminum, copper, titanium, iron, nickel alloy, other metal, or another substantially conductive material. Signal pin insulators 315*a-b* can be embedded in the conductive body 305 and can surround signal pins 310*a-b*. Signal pin insulators 315*a-b* can operate to maintain signal quality and shield external noise or interference. Signal pin insulators 315*a-b* also can operate to separate the signal pin from the ground and/or other signals and also can provide mechanical support. Signal pin insulators 315*a-b* can be made of insulative materials including, for example, nylon, foam, polyester, or fiberglass. It should be understood that the signal pin insulators 315*a-b* are not required for the connector.

In some implementations, two ground pins 320*a-b* can be embedded in the conductive body 305 of the multi-channel connector 300 and operate to transfer return ground currents 325*a-b*. In other implementations, more than one ground pin can be embedded in the conductive body 305 of the multi-channel connector 300. In some implementations, the ground pins 320*a-b* can be formed from the conductive body 305 and thus comprise the same material. In other implementations, the ground pins 320*a-b* can be made of a separate material such as aluminum, titanium, iron, or nickel alloy, and subsequently connected to the conductive body 305. In still further implementations, a single ground pin can be imbedded in the conductive body 305.

The signal pins 310*a-b* can operate to transmit and/or receive signals to/from one end of the connector to the device, connector, or apparatus to the other end. In addition, the ground pins 320*a-b* can operate to transfer return ground current 325*a-b* from the signal transmission. One channel's return ground current 325*a* can be designed to flow to its respective ground pin 320*a* based upon the skin effect. Correspondingly, an adjacent channel's return ground current 325*b* is intended to flow to its respective ground pin 320*b*.

Crosstalk 330*a-b* can occur occurs when return ground current from one channel (e.g., signal pin 310*a* of aggressor channel 335) flows into an adjacent channel's return current path (e.g., signal pin 310*b* and/or ground pin 320*b* of victim channel 340), resulting in reduced signal quality. A selectively resistive material 345 can be applied between signal pins 310*a-b*, signal pin insulators 315*a-b*, and/or ground pins 320*a-b* to reduce crosstalk. The effective resistance of the selectively resistive material 335 can be greater than the resistance of the conductive body 305 and less than the resistance of an insulating material.

In some implementations, the selectively resistive material 345 can be embedded in the connector during the manufacturing process. In other implementations, the selectively resistive material 345 can be applied to the surface of the connector with an epoxy, metal plate, or coating. It should be understood that the selectively resistive material 345 can be variable in shape or size. Moreover, the selectively resistive material 345 can be placed in various spatial configurations on the conductive body 305 to reduce crosstalk. In alternative implementations, the conductive body 305 can be made of the selectively resistive material and plated with a more conductive material in areas that can allow the area of un-plated resistive material to reduce crosstalk.

Figure 4:
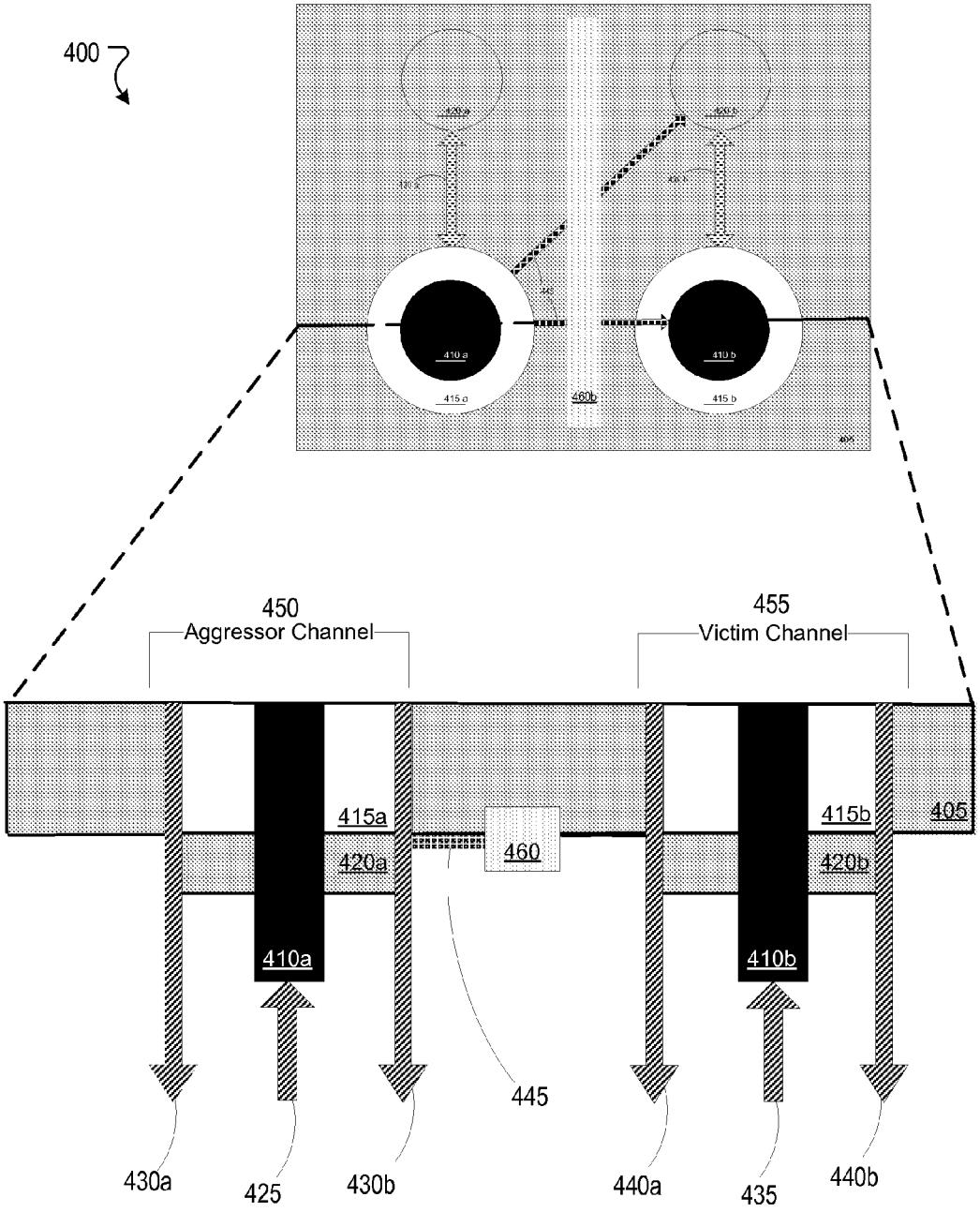
FIG. 4 is a block diagram illustrating an example bottom view and a cross-section of a multi-channel conductive body connector operating to reduce crosstalk.

FIG. 4 is a block diagram illustrating a cross-section of a multi-channel conductive body connector operating to reduce crosstalk. The connector 400 can include a conductive body 405 (e.g., conductive body 305 of FIG. 3), signal pins 410*a-b* (e.g., signal pin 310*a-b* of FIG. 3), signal pin insulators 415*a-b* (e.g., signal pin insulator 315*a-b* of FIG. 3), and ground pins 420*a-b* (e.g., ground pin 320*a-b* of FIG. 3). In some implementations, a single ground pin can be constructed. In other implementations, the signal pin insulators 415*a-c* are not required in the connector. The signal pins 410*a-b* can carry signals 425/435 to a connected apparatus or device. The return ground current 430*a-b* for a signal 425 is designed to flow to the nearest ground pin 420*a*. Correspondingly, a return ground current 440*a-b* for a second signal 435 is designed to flow to its respective ground pin 420*b*.

Return current induced crosstalk 445 (e.g., crosstalk 330*a-b* of FIG. 3) occurs when one channel's return ground current 430*a-b* flows to an adjacent signal pin 410*b* and/or ground pin 420*b*. The originator of the offending return ground current can be identified as an aggressor channel 450. The receiver of the offending return ground current can be identified as a victim channel 455. The crosstalk 445 caused by the aggressor channel 450 can affect signal quality and transmission to the victim channel 455

To reduce crosstalk, a selectively resistive material 460 (e.g., selectively resistive material 345 of FIG. 3) can be applied to the area between the signal pins 410*a-b* (e.g., signal pins 310*a-b*, FIG. 3), signal pin insulators 415*a-b* (e.g., signal pin insulators 315*a-b*, FIG. 3), and/or ground pins 420*a-b* (e.g., ground pins 320*a-b*, FIG. 3). In some implementations, the selectively resistive material 460 can be placed directly in between adjacent elements. In other implementations, the selectively resistive material 460 can be placed in various locations in/on the conductive body 405 to reduce crosstalk. In still further implementations, the selectively resistive material 460 can be embedded into the conductive body 405 during the manufacturing process. In those implementations where the selectively resistive material is applied after the manufacturing process, the selectively resistive material 460 can be applied to the surface with an epoxy, metal plate, or coating or other method during or after the manufacturing process. In alternative implementations, the conductive body 405 can be made of the selectively resistive material and plated with a more conductive material in areas that can allow the area of un-plated resistive material to reduce crosstalk.

Figure 5:
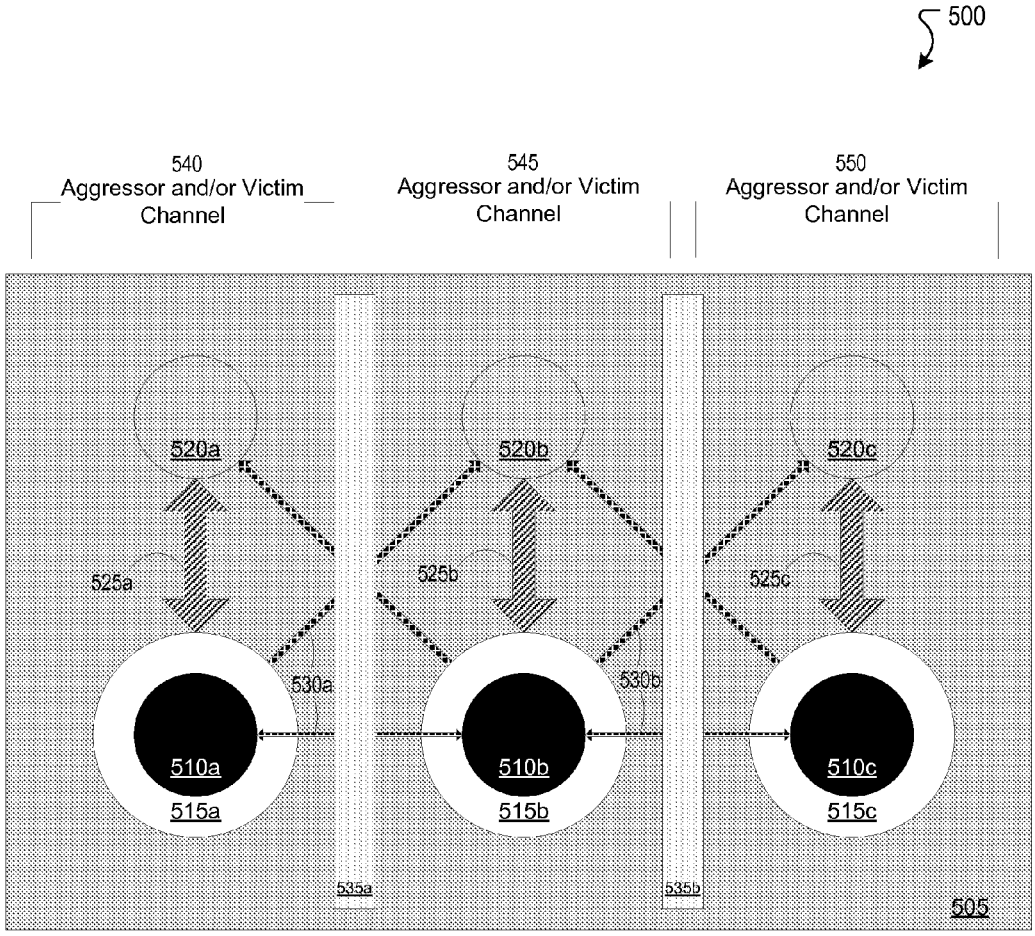
FIG. 5 is a block diagram illustrating another example bottom view of a multi-channel conductive body connector operating to reduce crosstalk.

FIG. 5 is a block diagram illustrating another bottom view of an example multi-channel conductive body connector operating to reduce crosstalk. In some implementations, the connector can attach to a circuit board or device. In other implementations, the connector can attach to another connector or to a cable. The connector 500 can include a conductive body 505, signal pins 510*a-c*, signal pin insulators 515*a-c*, and ground pins 520*a-c*. In some implementations, the conductive body 505 can be a single body made of one or more conductive materials. For example, the conductive body 505 can be comprised of one or more of alloys of copper, nickel, zinc, tin, other metal, or another substantially conductive material. In some implementations, a single ground pin can be constructed. In other implementations, the signal pin insulators 515*a-c* are not required in the connector.

The signal pins 510*a-c* can operate to transmit and/or receive data in the form of electrical signals. In some implementations, the signal pins 510*a-b* can be made of aluminum, copper, titanium, iron, nickel alloy, other metal, or another substantially conductive material. Signal pin insulators 515*a-c* can be embedded in the conductive body 505 and can surround signal pins 510*a-c*. Signal pin insulators 515*a-c* can operate to maintain signal quality and shield external noise or interference. Signal pin insulators 515*a-c* also can operate to separate the signal pin from the ground and/or other signals and also can provide mechanical support. The insulative materials used to make the signal pin insulators 515*a* can include, for example, nylon, foam, polyester, or fiberglass, among many others. In some implementations, the signal pin insulators 515*a-c* are not required in the connector. It should be understood that the signal pin insulators 515*a-c* are not required for the connector.

In some implementations, the ground pins 520*a-c* can be formed from the conductive body 505 and thus comprise the same material. In other implementations, the ground pins 520*a-c* can be made of a separate material such as aluminum, titanium, iron, or nickel alloy, and subsequently connected to the conductive body 505. In some implementations, a single ground pin can be constructed.

The signal pins 510*a-c* can operate to transmit and/or receive signals to/from one end of the connector to the device, connector, or apparatus to the other end. In addition, the ground pins 520*a-c* can operate to transfer return ground current 525*a-c* from the signal pins 510*a-c*, respectively. Return ground current 525*a* from one channel can be designed to flow to its respective ground pin 520*a* based on the skin effect. Correspondingly, an adjacent channel's return ground current 525*b-c* can be designed to flow to its respective ground pin 520*b-c*.

Crosstalk 530*a-b* can occur when return ground current from one channel flows to an adjacent channel signal and/or ground pin. Crosstalk 530*a-b* typically results in reduced signal quality. A selectively resistive material 535*a-b* can be applied between signal pins 510*a-c*, signal pin insulators 515*a-c*, and/or ground pins 520*a-c* to reduce crosstalk. The effective resistance of the selectively resistive material 535*a-b* can be greater than the resistance of the conductive body 505 and less than the resistance of an insulating material. The originator of the offending return ground current can be identified as an aggressor channel. The receiver of offending return ground current can be identified as a victim channel. Channels 540/545/550 in this connector may act as an aggressor or a victim.

In some implementations, the selectively resistive material 535*a-b* can be embedded in the connector during the manufacturing process. In other implementations, the selectively resistive material 535*a-b* can be applied to the surface of the connector after manufacturing with an epoxy, metal plate, or coating. It should be understood that the selectively resistive material 535*a-b* can be variable in shape or size. Moreover, the selectively resistive material 535*a-b* can be placed in various configurations on the conductive body 505 to reduce crosstalk. In alternative implementations, the conductive body 505 can be made of the selectively resistive material and plated with a more conductive material in areas that can allow the area of un-plated resistive material to reduce crosstalk.

Figure 6:
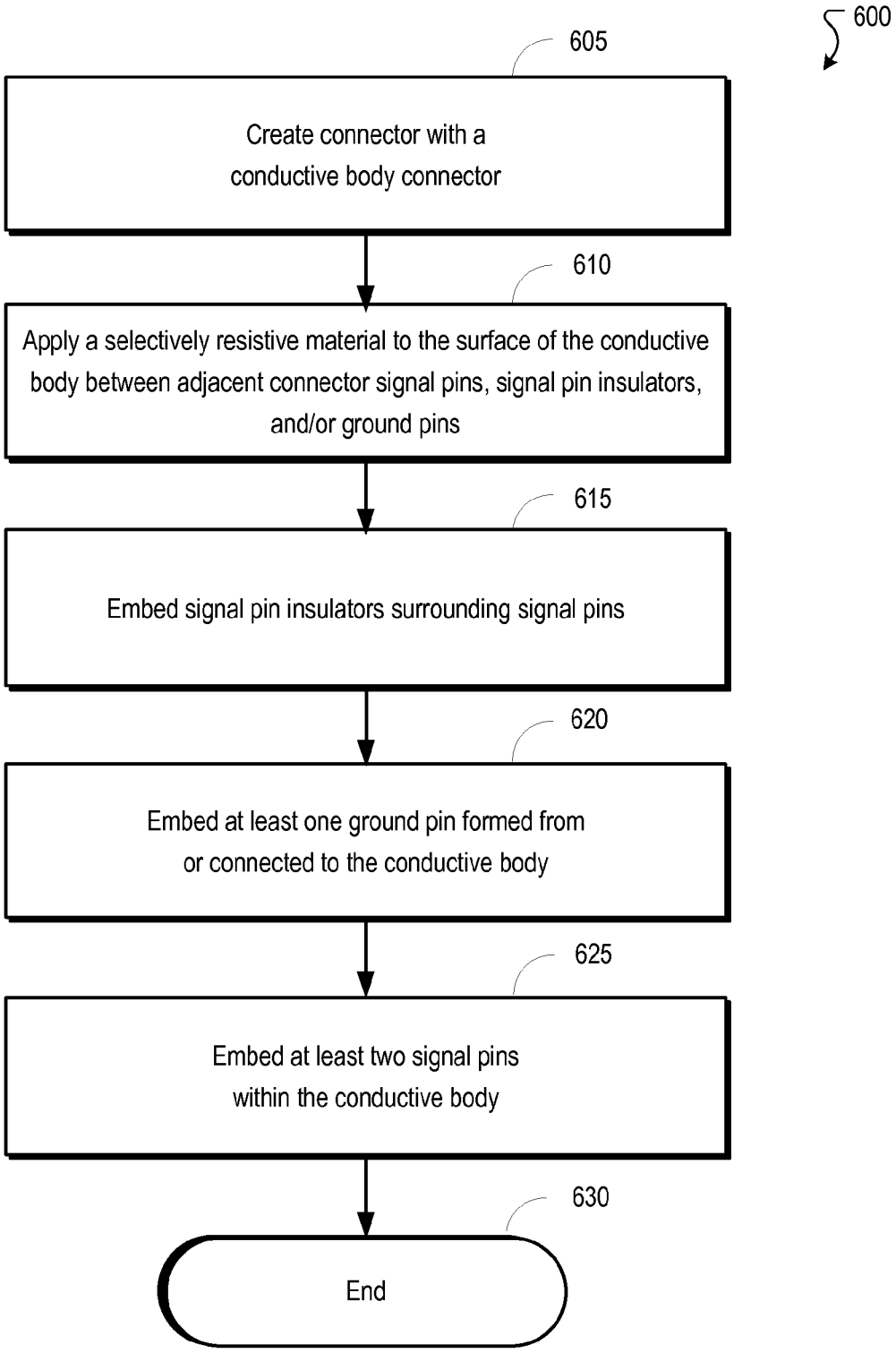
FIG. 6 is a flowchart illustrating an example process for manufacturing of a multi-channel conductive body connector operating to reduce crosstalk.

FIG. 6 is a flowchart illustrating an example process for manufacturing of a multi-channel conductive body connector operating to reduce crosstalk. The process 600 can begin at stage 605 when the multi-channel connector can be created by producing a conductive body connector (e.g., conductive body 505 in FIG. 5) operable to contain signal pins, signal pin insulators, ground pin(s), and selectively resistive material. In some implementations, the conductive body can be made of a single material. In other implementations, the conductive body can be made of materials formed into a single body. The conductive body can be made of one or more of a conductive metal such as, for example, zinc or brass alloys and plated with nickel or tin alloys and/or finished in palladium, silver and/or gold.

At stage 610 a selectively resistive material can be applied to the surface of the single conductive body between adjacent connector signal pins, signal pin insulators, and/or ground pin(s). The selectively resistive material (e.g., selectively resistive material 535*a-b* in FIG. 5) can be embedded, for example, by a manufacturing process and subsequently inserted into the conductive body (e.g., conductive body 505 in FIG. 5). In some implementations, the selectively resistive material can applied after manufacturing and can be placed directly in between a combination of adjacent elements. In other implementations, the selectively resistive material can be embedded into the conductive body during the manufacturing process. In those implementations where the selectively resistive material is applied after the manufacturing process, an epoxy, metal plate, or coating can be used to apply the selectively resistive material to the surface of the conductive body. In alternative implementations, the conductive body can be made of the selectively resistive material and plated with a more conductive material in areas that can allow the area of un-plated resistive material to reduce crosstalk.

At stage 615, a signal pin insulator is embedded in the conductive body. The signal pin insulators (e.g., signal pin insulators 515*a-c* in FIG. 5) can be embedded, for example, by a manufacturing process and subsequently inserted surrounding signal pins (e.g., signal pins 510*a-c* in FIG. 5) and inserted into the conductive body (e.g., conductive body 505 in FIG. 5). Signal pin insulators can be made of one or more insulative materials including, for example, nylon, foam, polyester, or fiberglass. In other implementations, the signal ping insulators are not required in the connector.

At stage 620, at least one ground pin is formed from or connected to the conductive body. The ground pin(s) (e.g., ground pins 520*a-c* in FIG. 5) can be embedded, for example, by a manufacturing process and subsequently inserted into the conductive body (e.g., conductive body 505 in FIG. 5). Ground pin(s) can be embedded in the conductive body of the connector and can operate to return ground currents. In some implementations, ground pin(s) can be formed from the conductive body and thus comprise the same material. In other implementations, ground pin(s) can be made of a separate material such as one or more of aluminum, titanium, iron, or nickel alloy, and subsequently connected to the conductive body.

At stage 625 at least two signal pins are embedded in the conductive body. The signal pins (e.g., signal pins 510*a-c* in FIG. 5) can be operable to transmit electrical signals and be embedded, for example, by a manufacturing process and subsequently inserted into the conductive body (e.g., conductive body 505 in FIG. 5). The signal pins can be made of a conductive metal such as, for example, copper alloy plated in tin, nickel, palladium, silver and/or gold. The process 600 ends at stage 630.

What is claimed is:

1. A reduced crosstalk connector comprising:

a conductive body;

at least two signal pins embedded in the conductive body;

at least one ground pin connected to the conductive body; and a selectively resistive material coupled to the conductive body and applied between adjacent signal pins of the at least two signal pins, thereby controlling return ground current induced crosstalk using the selectively resistive material.

2. The reduced crosstalk connector of claim 1, wherein the selectively resistive material is applied on a surface of the conductive body.

3. The reduced crosstalk connector of claim 2, wherein a signal pin insulator surrounds one of the at least two signal pins, the signal pin insulator being embedded in the conductive body.

4. The reduced crosstalk connector of claim 2, wherein the at least one ground pin is formed from the conductive body.

5. A reduced crosstalk connector comprising:

a conductive body comprised of a selectively resistive material;

at least two signal pins embedded in the conductive body;

at least one ground pin connected to the conductive body; and a conductive metal plating along an intended current path on a surface of the conductive body, the conductive metal plating not between adjacent signal pins of the at least two signal pins, the conductive metal plating being operable to control return ground current induced crosstalk within the conductive body.

6. The reduced crosstalk connector of claim 5, wherein a signal pin insulator surrounds one of the at least two signal pins, the signal pin insulator being embedded in the conductive body.

7. The reduced crosstalk connector of claim 5, wherein the at least one ground pin is formed from the conductive body.

* * * * *